US011456555B1

(12) United States Patent
Lin

(10) Patent No.: US 11,456,555 B1
(45) Date of Patent: Sep. 27, 2022

(54) SAFETY SOCKET

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 17/347,616

(22) Filed: Jun. 15, 2021

(51) Int. Cl.
*H01R 13/44* (2006.01)
*H01R 13/453* (2006.01)

(52) U.S. Cl.
CPC ..... *H01R 13/4534* (2013.01)

(58) Field of Classification Search
CPC ..... H01R 13/4534; H01R 13/4536; H01R 13/4538; H01R 13/4532; H01R 13/453; H01R 13/447; H01R 13/44
USPC ..... 439/137
See application file for complete search history.

(56) References Cited

U.S. PATENT DOCUMENTS 6,149,446 A * 11/2000 Yu ..... H01R 13/4534 439/145
6,537,089 B1 * 3/2003 Montague ..... H01R 13/4534 439/145
6,776,630 B1 * 8/2004 Huang ..... H01R 13/4534 439/145
7,452,221 B1 * 11/2008 Oddsen ..... H01R 13/4534 439/140
7,527,508 B1 * 5/2009 Lee ..... H01R 13/4534 439/137
7,588,447 B1 * 9/2009 Ni ..... H01R 24/70 439/137
7,637,756 B1 * 12/2009 Hsu ..... H01R 13/4534 439/145
7,645,149 B2 * 1/2010 Carbone ..... H01R 13/4534 439/137
7,941,307 B2 * 5/2011 Symington ..... E21B 49/006 703/10
7,942,681 B2 * 5/2011 Ni ..... H01R 13/4534 439/145
8,382,497 B2 * 2/2013 Huang ..... H01R 13/7135 439/137
8,562,362 B2 * 10/2013 Jiang ..... H01R 13/4534 439/145
8,632,347 B2 * 1/2014 Chen ..... H01R 13/453 439/145
9,312,625 B2 * 4/2016 Shen ..... H01R 13/4534
2002/0066656 A1 * 6/2002 Shao ..... H01R 13/4534 200/51 R
2003/0017731 A1 * 1/2003 Huang ..... H01R 13/4534 439/137
2004/0147148 A1 * 7/2004 Ng ..... H01R 13/4534 439/137
2015/0037989 A1 * 2/2015 Byrne ..... H01R 13/4534 439/137
2015/0064944 A1 * 3/2015 Scanzillo ..... H01R 13/4534 439/137

* cited by examiner

*Primary Examiner* — Harshad C Patel
(74) *Attorney, Agent, or Firm* — WPAT, PC

(57) ABSTRACT

A safety socket is disclosed, comprising a socket body, an outer mold sleeve, a torsion rotating spring and a protective block body, and when any foreign object may be potentially inserted into the socket body, the foreign object will be effectively blocked by the protective block body such that it cannot smoothly enter therein, thus achieving the feature of safety protection.

5 Claims, 6 Drawing Sheets

SAFETY SOCKET

BACKGROUND OF THE INVENTION

1. Field of the Invention

The present invention relates to a safety socket, which is a socket structure for connecting a plug to provide electric power, and the said socket structure enables the security protection effect.

2. Description of Related Art

Since humans have known the use of electricity, human civilizations have made significant and rapid advancements in the development of various technologies and industries, and electrical energy and numerous electrical appliances greatly influence human lives which are today closely connected with such electrical energy and electrical appliances; in addition, electrical requirements exist with respect to both indoor and outdoor usages, so numerous types of sockets are distributed in order to provide electricity to meet the needs of electricity.

In prior art, the conventional socket has no special protective structure, and although the energized structure of the conventional socket is protected within a case, typically the socket hole is still exposed, and it is possible to use an elongated object (e.g., an iron wire, a pin, etc.) to easily insert into the socket hole, which may result in damaging the structure of the socket and causing dangerous electric shock accidents or public hazardous events, like fires; and people should be even more prudent and cautious especially for the environment with young children.

As such, the present invention refines and strengthens the internal structural resistance of the socket, in which a structure featuring a stop-blocking effect is designed between the socket hole and the energizing structure such that an elongated object cannot easily pass through the socket hole to enter the inside, thereby effectively preventing the internal structure of the socket from being damaged and avoiding dangerous electric shock, fire and other terrible accidents. This is the solution provided by the safety socket according to the present invention.

SUMMARY OF THE INVENTION

A safety socket, comprising:

a socket body, having a case component which is internally configured with plural inner socket holes, with the opening of each of such inner socket holes being openly configured on one side of the case component, in which a first slope is configured between two of the openings and a conductive component is respectively installed in the inside of each of such inner socket hole;

an outer mold sleeve, installed on the side of the case component having the opening, in which plural outer socket holes are openly configured on the outer mold sleeve and a groove chamber is also openly configured inside the outer mold sleeve, with the positions and number of such outer socket holes corresponding to each of the inner socket holes such that each of the outer socket holes respectively connects in communication with each of the inner socket holes by way of the groove chamber;

a torsion rotating spring, located within the groove chamber and having a fixation end fixed to the case component and a torsion rotating end, in which the torsion rotating end may rotate relatively to the fixation end as the center of the circle upon being affected by external force, and return to its original position once the external force is removed; and a protective block body, located in the groove chamber, in which one side of the protective block body is convexly configured with two stop bumps respectively corresponding to such two outer socket holes therein, and the other side of the protectively block body is convexly configured with a guiding tilted bump whose outer side forms a second slope attaching to the first slope, with the inner side thereof forming a corner recess for hook-attaching to the torsion rotating end; in addition, the protective block body is also openly configured with a through-hole which is adjacent to the side of the stop bump comparatively remote to second slope.

In a preferred embodiment, three outer socket holes are configured, respectively a live wire hole, a neutral wire hole and a ground wire hole, and two stop bumps respectively correspond to the live wire hole and the neutral wire hole.

In a preferred embodiment, the guiding tilted bump is relatively located close to the middle position between the two stop bumps.

In a preferred embodiment, a first guiding slope is respectively configured on the inner side of each of the outer socket holes neighboring the groove chamber, and a second guiding slope having the same inclination is respectively configured on the side corresponding to the first guiding slope of each of the stop bumps, such that, when such two stop bumps are respectively located within each of the outer socket holes, the second guiding slope attaches to the first guiding slope.

In a preferred embodiment, the first guiding slope and the second guiding slope respectively have the same inclination as the first slope.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
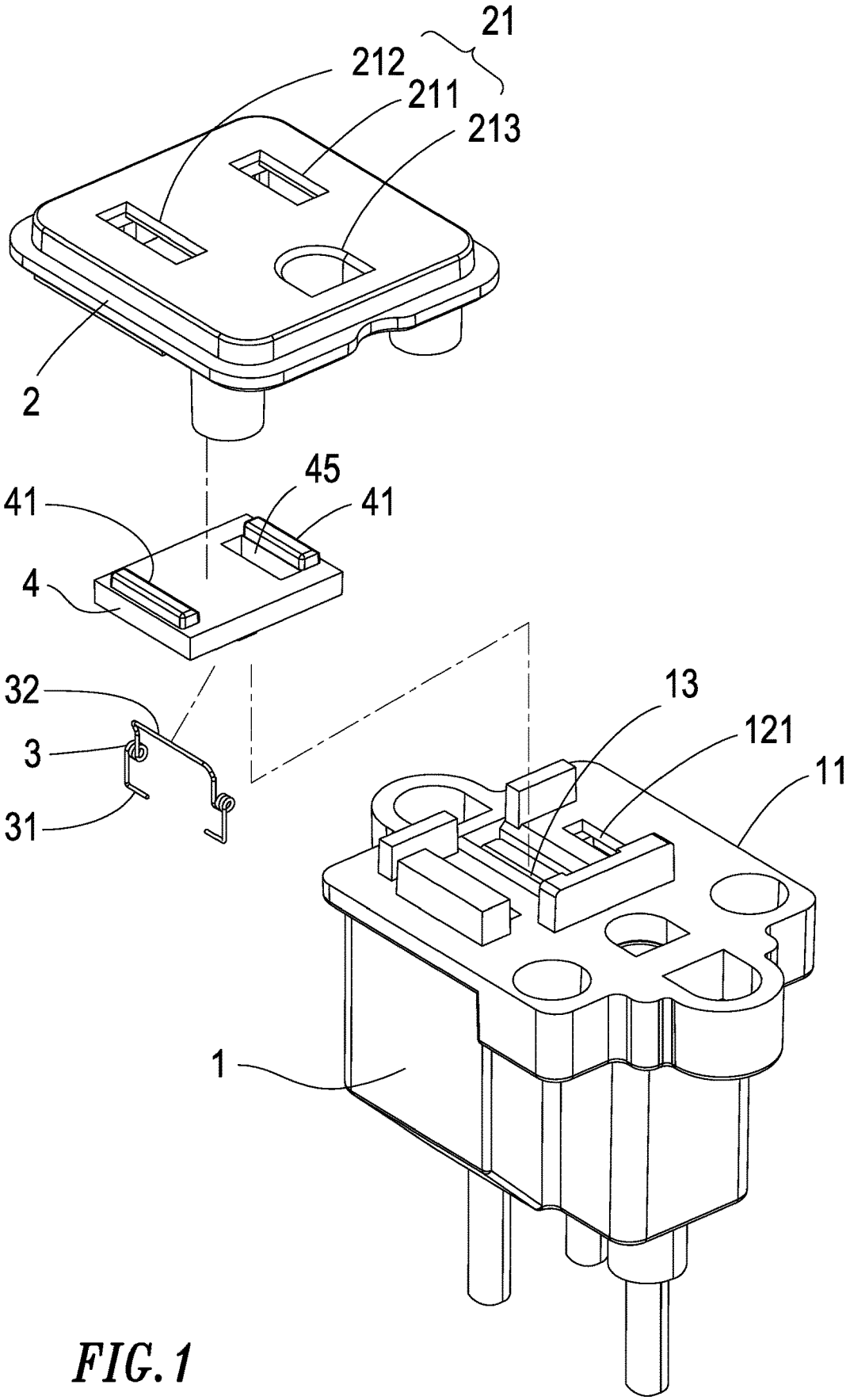
FIG. 1 shows a stereo disassembly view for the integral structure of the safety socket according to the present invention.
Figure 2:
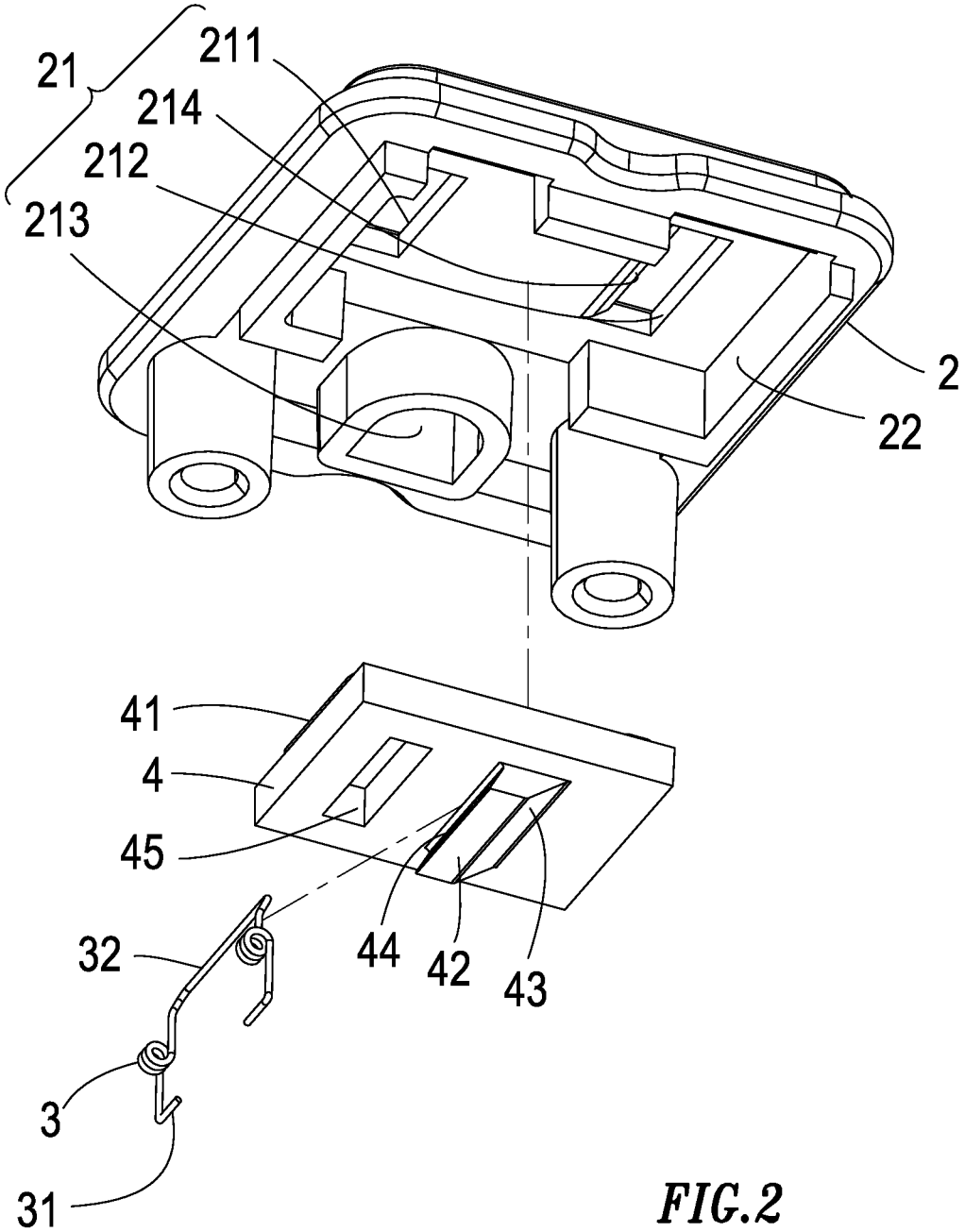
FIG. 2 shows a stereo disassembly view for a local structure of the safety socket according to the present invention.
Figure 3:
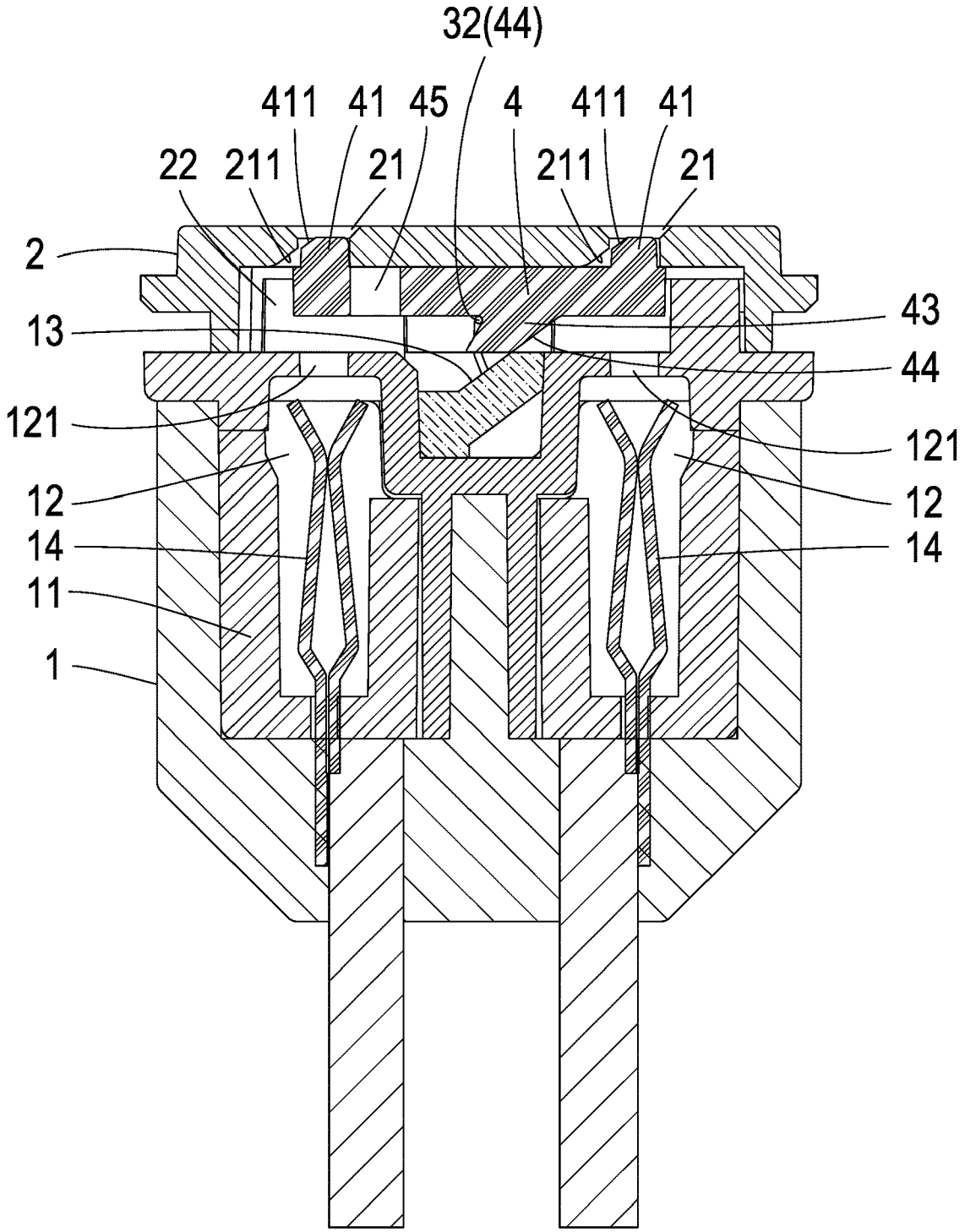
FIG. 3 shows a cross-sectioned view for the integral structure of the safety socket according to the present invention.

Referring first to FIGS. 1-3, wherein a stereo disassembly view and an internal structure cross-sectioned view of the safety socket according to the present invention are respectively shown, and it can be seen that the illustrated safety socket comprises a socket body 1, an outer mold sleeve 2, a torsion rotating spring 3 and a protective block body 4.

Herein the socket body 1 has a case component 11 which is internally configured with plural inner socket holes 12, with the opening 121 of each of such inner socket holes 12 being openly configured on one side of the case component 11, in which a first slope 13 is configured between two of the openings 121 and a conductive component 14 is respectively installed in the inside of each of such inner socket hole 12.

In addition, the outer mold sleeve 2 is installed on the side of the case component 11 having the opening 121, in which plural outer socket holes 21 are openly configured on the outer mold sleeve 11 and a groove chamber 22 is also openly configured inside the outer mold sleeve 11, with the positions and number of such outer socket holes 21 corresponding to each of the inner socket holes 12 such that each of the outer socket holes 21 respectively connects in communication with each of the inner socket holes 12 by way of the groove chamber 22. In the present embodiment, three outer socket holes 21 are configured; respectively, a live wire hole 211, a neutral wire hole 212 and a ground wire hole 213.

Moreover, the torsion rotating spring 3 is located within the groove chamber 22 and has a fixation end 31 fixed to the case component 11 and a torsion rotating end 32, in which the torsion rotating end 32 may rotate relatively to the fixation end 31 as the center of the circle upon being affected by external force, and return to its original position once the external force is removed.

Also, the protective block body 4 is located in the groove chamber 22, in which one side of the protective block body 4 is convexly configured with two stop bumps 41 respectively corresponding to the live wire hole 211 and the neutral wire hole 212 therein, and the other side of the protectively block body 4 is convexly configured with a guiding tilted bump 42 which is relatively located close to the middle position between the two stop bumps 41 and whose outer side forms a second slope 43 attaching to the first slope 13, with the inner side thereof forming a corner recess 44 for hook-attaching to the torsion rotating end 32; in addition, the protective block body 4 is also openly configured with a through-hole 45 which is adjacent to the side of the stop bump 41 comparatively remote to second slope 43.

Referring now to FIGS. 1 and 3, in the safety socket according to the present invention, without the influence from external force, it can be appreciated that the torsion rotating end 32 pushes and abuts against the protective block body 4 in the direction away from the fixation end 31 such that the two stop bumps 41 can be pushed into the live wire hole 211 and the neutral wire hole 212, and the protective block body 4 blocks the communication between each of the outer socket holes 21 and each of the inner socket holes 12 in the groove chamber 22.

Figure 4:
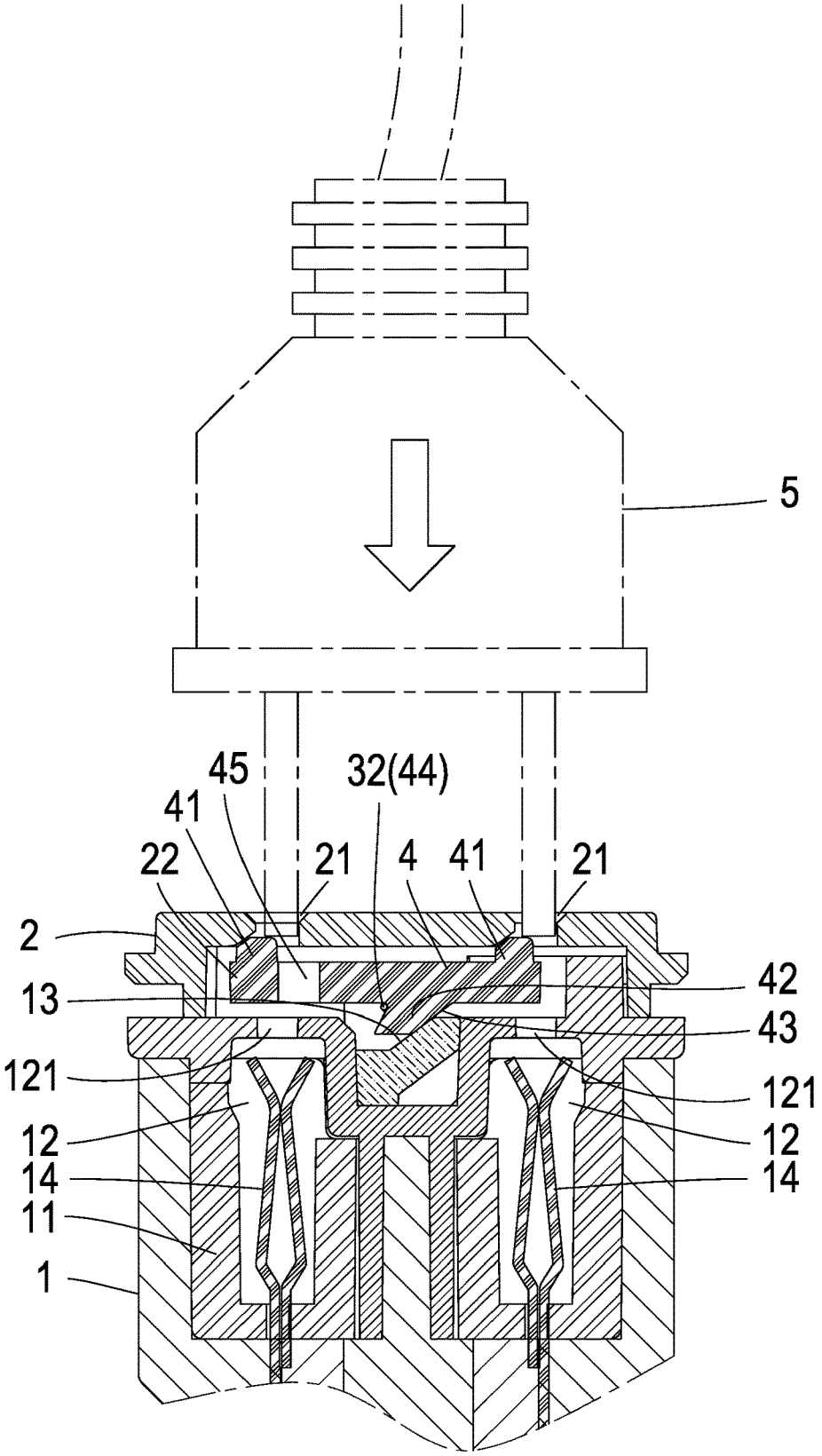
FIG. 4 shows a cross-sectioned view for the plug insertion embodiment of the safety socket according to the present invention.
Figure 5:
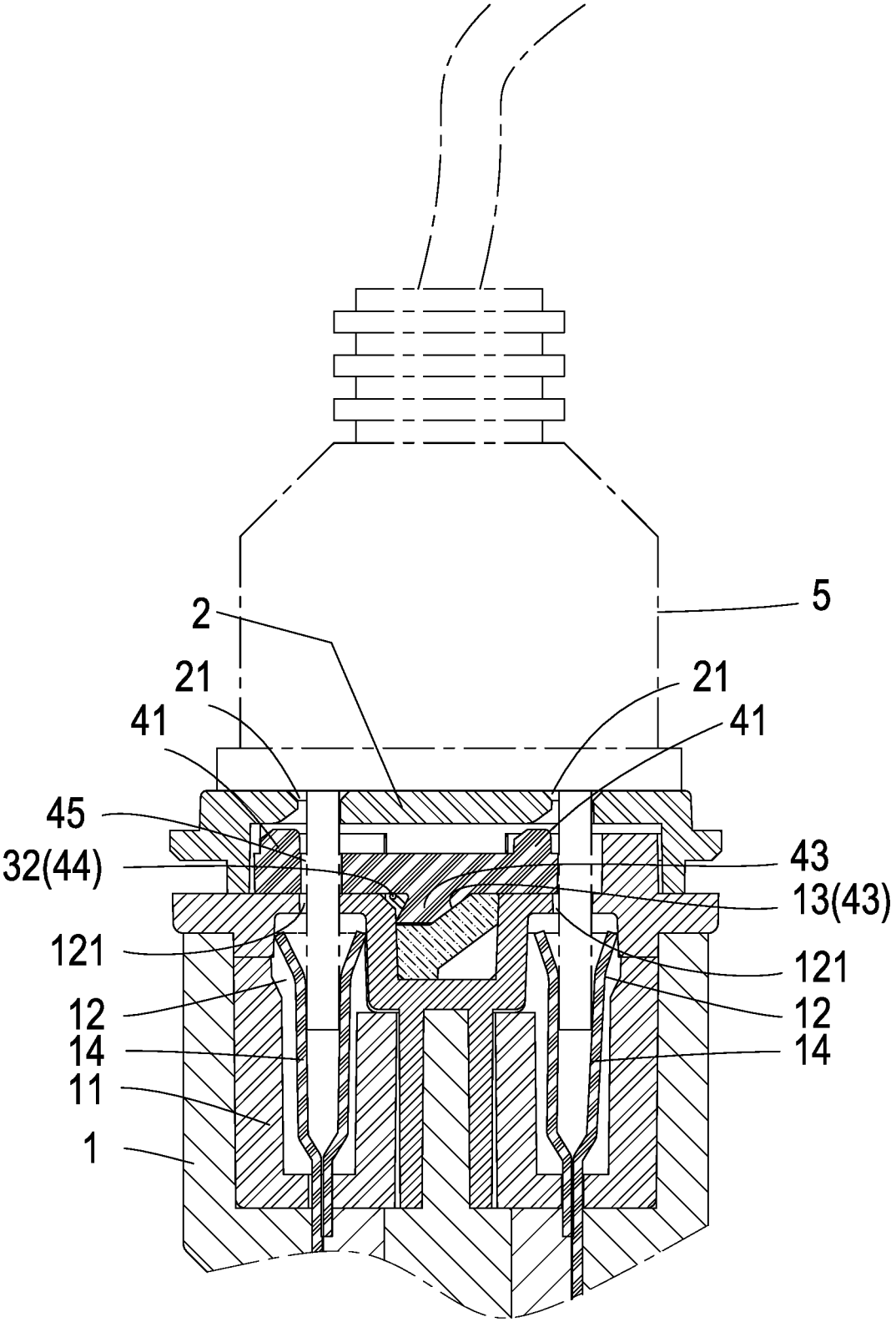
FIG. 5 shows a cross-sectioned view for the plug insertion embodiment of the safety socket according to the present invention.

Refer next to FIGS. 1, 4 and 5, wherein, upon using a plug 5 to insert, the plug 5 simultaneously pushes both of the two stop bumps 41 in the direction of the socket body 1 in the live wire hole 211 and the neutral wire hole 212, and, at this moment, the second slope 43 attaches and slides along the inclination direction of the first slope 13, such that the direction in which the protective block body 4 is being pushed deviates in correspondence with the inclination direction of the first slope 13, and such a deviation of the protective block body 4 allows to completely sidestep one of the outer socket hole 21 and the inner socket hole 12, while the other one of the outer socket hole 21 and the inner socket hole 12 corresponds to the through-hole 45 thereby allowing each of the outer socket holes 21 and each of the inner socket holes 12 connect in communication so as to let the plug 5 smoothly insert into each of the inner socket holes 12 to connect to each of the conductive components 14 for electrical conductance.

Figure 6:
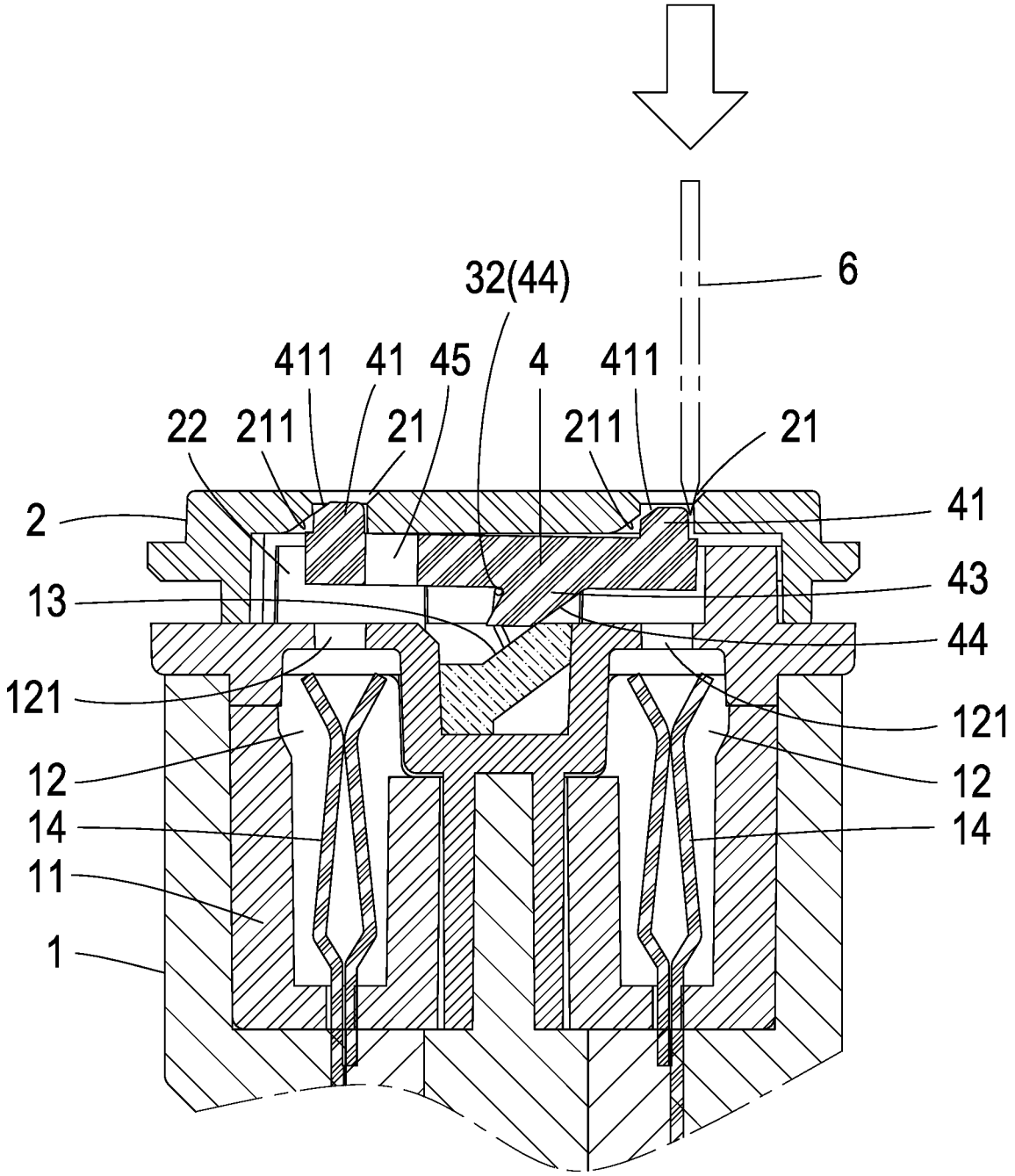
FIG. 6 shows a cross-sectioned view for the foreign object insertion embodiment of the safety socket according to the present invention.

Moreover, refer to FIGS. 1 and 6, it can be seen that, when a foreign object 6 is used for insertion, the foreign object 6 may push one of the stop bumps 41 in one of the live wire hole 211 or the neutral wire hole 212 towards the socket body 1; in this case, since the torsion rotating end 32 forms a fulcrum at the corner recess 44, the foreign object 6 pushes only one of the stop bumps 41, the protective block body 4 will rotate based on the circle center at the fulcrum formed by the torsion rotating end 32, such that the other stop bump 41 pushes in the direction of the outer mold sleeve 2; however, since the stop bump 41 is stuck in the live wire hole 211 or the neutral wire hole 212, the stop bump 41 pushed by the foreign object 6 can not push the entire protective block body 4 thus that the foreign object 6 is effectively blocked and can not enter into the inner socket hole 12 so as not to further connect to each of the conductive components 14, and security protect effect can be successfully achieved.

Furthermore, referring to FIGS. 1-3, in the safety socket according to the present invention, a first guiding slope 214 is respectively configured on the inner side of each of the outer socket holes 21 neighboring the groove chamber 22, and a second guiding slope 411 having the same inclination is respectively configured on the side corresponding to the first guiding slope 214 of each of the stop bumps 41, such that, when such two stop bumps 41 are located within the live wire hole 211 and the neutral wire hole 212, each second guiding slope 411 attaches to the first guiding slope 214; in addition, the first guiding slope 214 and the second guiding slope 411 respectively have the same inclination as the first slope 13 (and the same for the second slope 43) so that, when the protective block body 4 deviates correspondingly in the inclination direction of the first slope 13, the first guiding slope 214 attaching to the second guiding slope 411 may act to guide each of the stop bumps 41 thereby making the deviation smoother.

The previously disclosed embodiments are merely illustrative of some preferred ones of the present invention, which are not intended to limit the scope thereof; those who are skilled in the relevant technical fields can, after understanding the technical features and embodiments of the present invention as explained hereinabove, certainly make equivalent changes, alterations or modifications without departing from the spirit and scope of the present invention, which are nonetheless deemed as falling within the coverage of the present invention; accordingly, the scope of the present invention to be protected by patent laws is subject to the definition of the claims attached to this specification.

What is claimed is:

1. A safety socket, comprising:

a socket body, having a case component which is internally configured with plural inner socket holes, with the opening of each of such inner socket holes being openly configured on one side of the case component, in which a first slope is configured between two of the openings and a conductive component is respectively installed in the inside of each of such inner socket hole;

an outer mold sleeve, installed on the side of the case component having the opening, in which plural outer socket holes are openly configured on the outer mold sleeve and a groove chamber is also openly configured inside the outer mold sleeve, with the positions and number of such outer socket holes corresponding to each of the inner socket holes such that each of the outer socket holes respectively connects in communication with each of the inner socket holes by way of the groove chamber;

a torsion rotating spring, located within the groove chamber and having a fixation end fixed to the case component and a torsion rotating end, in which the torsion rotating end may rotate relatively to the fixation end as the center of the circle upon being affected by external force, and return to its original position once the external force is removed; and a protective block body, located in the groove chamber, in which one side of the protective block body is convexly configured with two stop bumps respectively corresponding to such two outer socket holes therein, and the other side of the protectively block body is convexly configured with a guiding tilted bump whose outer side forms a second slope attaching to the first slope, with the inner side thereof forming a corner recess for hook-attaching to the torsion rotating end; in addition, the protective block body is also openly configured with a through-hole which is adjacent to the side of the stop bump comparatively remote to second slope.

2. The safety socket according to claim 1, wherein three outer socket holes are configured, respectively a live wire hole, a neutral wire hole and a ground wire hole, and two stop bumps respectively correspond to the live wire hole and the neutral wire hole.

3. The safety socket according to claim 1, wherein the guiding tilted bump is relatively located close to the middle position between the two stop bumps.

4. The safety socket according to claim 1, wherein a first guiding slope is respectively configured on the inner side of each of the outer socket holes neighboring the groove chamber, and a second guiding slope having the same inclination is respectively configured on the side corresponding to the first guiding slope of each of the stop bumps, such that, when such two stop bumps are respectively located within each of the outer socket holes, the second guiding slope attaches to the first guiding slope.

5. The safety socket according to claim 4, wherein the first guiding slope and the second guiding slope respectively have the same inclination as the first slope.

* * * * *